US006017641A

United States Patent [19]

Aoki et al.

[11] Patent Number: 6,017,641

[45] Date of Patent: Jan. 25, 2000

[54] COIL SPRING RESISTIVE TO DELAYED FRACTURE AND MANUFACTURING METHOD OF THE SAME

[75] Inventors: Toshinori Aoki, Nagoya; Taisuke Nishimura; Takashi Otowa, both of Wako, all of Japan

[73] Assignees: Chuo Hatsujo Kabshiki Kaisha, Nagoya; Honda Giken Kogyo Kabushiki Kaisha, Tokyo, both of Japan

[21] Appl. No.: 09/038,988

[22] Filed: Mar. 12, 1998

[51] Int. Cl.[7] ..... B21F 35/00; C21D 9/02

[52] U.S. Cl. ..... 428/544; 148/208; 148/212; 148/215; 148/230; 148/233; 148/580; 148/599; 148/660; 148/901; 148/908; 267/166; 428/592; 428/906

[58] Field of Search ..... 428/544, 592, 428/906; 148/208, 210, 212, 215, 230, 233, 580, 596, 599, 629, 660, 901, 908; 267/166

[56] References Cited

FOREIGN PATENT DOCUMENTS 04285142 10/1992 Japan .

OTHER PUBLICATIONS

Nishimura et al, SAE Technical Paper Series No. 890777, The Engineering Society for Advancing Mobility Land Sea Air and Space, "The Valve Springs Carbo–Nitrided at a High Temperature for High Speed Engines", International Congress and Exposition Detroit, Michigan, Feb. 27–Mar. 3, 1989.

*Primary Examiner*—Deborah Jones
*Assistant Examiner*—Robert R. Koehler
*Attorney, Agent, or Firm*—Nixon & Vanderhye P.C.

[57] ABSTRACT

A coil spring made of an oil-tempered steel wire with internal hardness of more than Hv 550 in cross-section, the surface hardness of the oil-tempered steel wire being determined in an extent between Hv 420 in a minimum value and hardness defined by subtraction of Hv 50 from the internal hardness in a maximum value.

5 Claims, 4 Drawing Sheets

□ Sample steel wire (1) $\sigma$ B=230kgf/mm2

▲ Comparative steel wire (III) $\sigma$ B=210kgf/mm2

COIL SPRING RESISTIVE TO DELAYED FRACTURE AND MANUFACTURING METHOD OF THE SAME

BACKGROUND-OF THE INVENTION

1. Field of the invention The present invention relates to a high strength coil spring made of an oil-tempered steel wire, and more Particularly to a manufacturing method of the coil spring capable of restraining delayed fracture of the coil spring.

2. Description of the Prior Art

In recent years, it is required to provide lightweight valve springs adapted for use in automotive engines. To satisfy such requirements, there have been proposed various methods for strengthening an oil-tempered steel wire for the valve springs. For example, there has been proposed an oil-tempered steel wire with tensile strength of more than 210 kgf/mm$^2$ and internal hardness of more than Hv 550, which contains 0.45 to 0.8% C, 1.2 to 2.5% Si. 0.5 to 1.5% Mn and 0.5 to 2.0% Cr, by weight and at least one metallic element selected from the group of 0.1 to 0.7% Mo, 0.05 to 0.6% V, 0.2 to 2.0% Ni and 0.01 to 0.2% Nb, by weight and contains Fe and impurity elements as a remainder.

In the oil-tempered steel wire of this kind, it has been found that there occur breakage of the steel wire during a cold coiling process and delayed fracture of the steel wire after the cold coiling process. Disclosed in Japanese Patent Laid-open Publication No. 4(1992)-285142 is a method of decarburizing the surface of the steel wire for preventing the steel wire from breakage during the cold coiling process. The surface hardness of the steel wire defined by decarburizing treatment prior to the oil-tempering process is, however, limited to less than Hv 400. For this reason, the effect of the nitriding treatment for increasing the surface hardness of the steel wire is reduced, resulting in decrease of fatigue strength of the valve springs. In addition, for increasing the surface hardness of the steel wire more than Hv 900 by nitriding treatment in an atmosphere of ammonia gas, it is required to carry out the nitriding treatment at 500 ° C. for more than six hours. This lowers the productivity of the steel wire. Furthermore, in the oil-tempered steel wire described above, delayed fracture of the steel wire will occur after the coiling process due to an increase of retained austenite and an increase of residual stress on the surface of the steel wire caused by the coiling process.

SUMMARY OF THE INVENTION

It is, therefore, a primary object of the present invention to provide a high strength coil spring resistive to delayed fracture without causing any problem discussed above.

According to an aspect of the present invention, the object is accomplished by providing a coil spring made of an oil-tempered steel wire with internal hardness of more than Hv 550 in cross-section, the surface hardness of the oil-tempered steel wire being determined in an extent between Hv 420 in a minimum value and hardness defined by subtraction of at least Hv 50 from the internal hardness in a maximum value.

In the coil spring, it is preferable that the oil-tempered steel wire is decarburized during heating prior to a quenching process thereof in such a manner that the surface hardness of the oil-tempered steel wire is determined in the extent between Hv 420 in a minimum value and hardness defined by subtraction of at least Hv 50 from the internal hardness in a maximum value.

According to another aspect of the present invention, the object is accomplished by providing a manufacturing method of a high strength coil spring made of an oil-tempered steel wire with internal hardness of more than Hv 550 in cross-section, comprising the steps of decarburizing the surface of the oil-tempered steel wire during hearing prior to a quenching process thereof to determine the surface hardness of the oil-tempered steel wire in an extent between Hv 420 in a minimum value and hardness defined by subtraction of Hv 5 from the internal hardness in a maximum value, and coiling the oil-tempered steel wire for making a coil spring.

BRIEF DESCRIPTION OF TEE DRAWINGS

In the drawings:

FIG. 5(*b*) is a graph showing the hardness of each of the comparative steel wires before the coiling process thereof and after the nitriding process thereof in relation to depth from the surface of the comparative steel wires.

DESCRIPTION OF TEE PREFERRED EMBODIMENT

Figure 1:
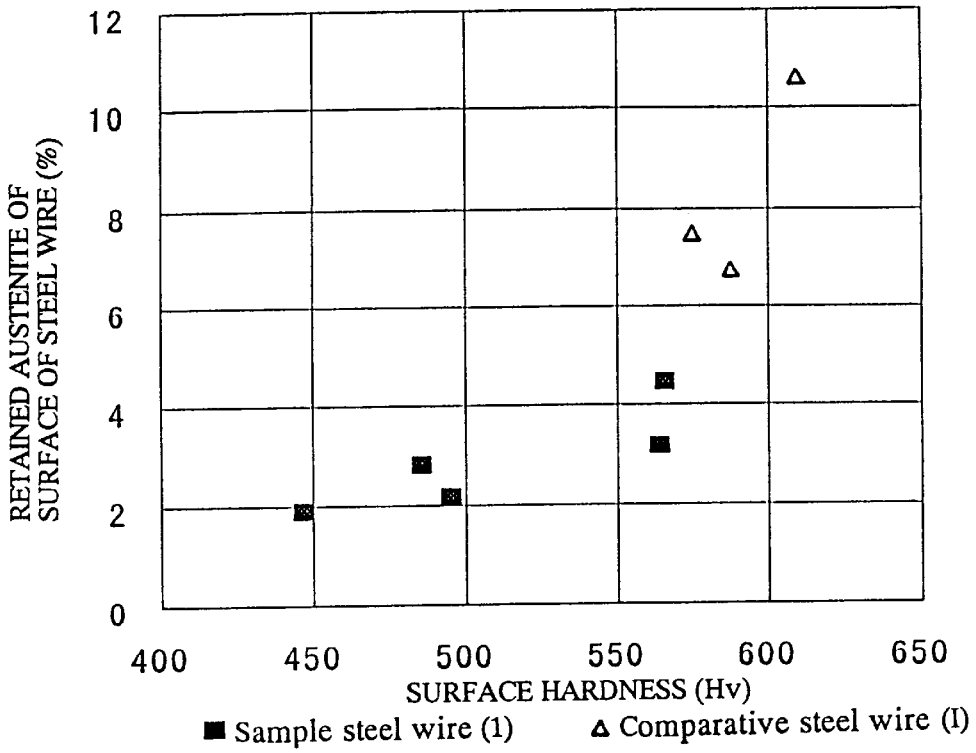
FIG. 1 is a graph showing retained austenite on the surface of each of a sample steel wire and comparative steel wires in relation to the surface hardness of each of the steel wires before a coiling process thereof.

Hereinafter, a preferred embodiment of the present invention will be described in detail on a basis of an experiment. In the following Table 1, there is illustrated each chemical composition of sample steel wires (1) to (5) of the present invention and comparative steel wires (I) to (III) adapted for an experiment in the preferred embodiment. As is understood from Table 1. each chemical composition of the sample steel wires (1) to (5) is essentially the same as each chemical composition of the comparative steel wires.

TABLE 1

| | C | Si | Mn | Cr | Mo | V | Ni | Nb |
|---|---|---|---|---|---|---|---|---|
| Sample wire (1) | 0.73 | 2.01 | 0.75 | 1.02 | 0.22 | 0.37 | — | 0.02 |
| Sample wire (2) | 0.75 | 2.01 | 0.79 | 0.79 | 0.21 | 0.45 | — | 0.02 |
| Sample wire | 0.75 | 2.00 | 0.71 | 1.27 | 0.21 | 0.27 | — | 0.02 |

TABLE 1-continued

| | C | Si | Mn | Cr | Mo | V | Ni | Nb |
|---|---|---|---|---|---|---|---|---|
| (3) | | | | | | | | |
| Sample wire (4) | 0.71 | 1.42 | 0.61 | 0.58 | 0.13 | 0.43 | — | — |
| Sample wire (5) | 0.75 | 2.01 | 0.75 | 1.02 | 0.22 | 0.37 | 1.0 | 0.02 |
| Comparative wire (I) | 0.73 | 2.01 | 0.75 | 1.02 | 0.22 | 0.37 | — | 0.02 |
| Comparative wire (II) | 0.73 | 2.01 | 0.75 | 1.02 | 0.22 | 0.37 | — | 0.02 |
| Comparative wire (III) | 0.71 | 1.42 | 0.61 | 0.58 | 0.13 | 0.43 | — | — |

In the following Table 2, there are shown each condition for oil-tempering the sample steel wire (1) the surface of which was decarburized by a method of the present invention and for oil-tempering the comparative steel wires (I) to (III) used without the decarburizing process and tensile strength of each of the steel wires (1) and (I) to (III) after treatment of the oil-tempering. Only the steel wire (1) was heated for quenching in an electric furnace filled with inert gas such as argon gas and decarburized in an atmosphere of mixed gases of argon, hydrogen and air. The oxidation and decarburization of the sample steel wire (1) were adjusted in accordance with change of a dew point, and the dew point was controlled by the amount of air.

TABLE 2

| | | Condition for oil-tempering | | |
|---|---|---|---|---|
| | Tensile strength | Quenching Temp. | Tempering Temp. | Atmosphere |
| Sample wire (1) | 230 kgf/mm$^2$ | 930° C. | 480° C. | H, Ar, Air |
| Comparative wire (I) | 230 kgf/mm$^2$ | 930° C. | 500° C. | Ar |
| Comparative wire (II) | 220 kgf/mm$^2$ | 930° C. | 500° C. | Ar |
| Comparative wire (III) | 210 kgf/mm$^2$ | 930° C. | 480° C. | Ar |

The sample steel wire (1) and comparative steel wires (I) to (III) each were formed as a rod of 3.4mm in diameter by cold drawing and applied with the treatment of quenching and oil-tempering under each condition listed in Table 2. The oil-tempered steel wires were coiled as in a specification listed in the following Table 3 and applied with treatment of nitriding and shot peening to make a sample coil spring and comparative coil springs.

TABLE 3

| | |
|---|---|
| Wire diameter | 3.4 mm |
| Average diameter of coils | 19.4 mm |
| Effective number of windings | 4.76 |
| Total number of windings | 6.76 |
| Height in free condition | 44.6 mm |
| Spring coefficient | 3.97 kgf/mm |

Illustrated in FIG. 1 is retained austenite on the surface of each of the sample steel wire (1) and comparative steel wires (I) to (III) in relation to the surface hardness of each or the steel wires before the coiling process. As is understood from FIG. 1, the retained austenite on the surface of the sample steel wire (1) after heat treatment was decreased as a result of decarburizing treatment prior to the quenching process, and the surface hardness of the sample steel wire (1) was decreased. The retained austenite causes martensite transformation during the coiling process to increase the surface hardness of the steel wire immediately after the coil process. This results in delayed fracture of the steel wire. It is, therefore, desired to reduce the retained austenite on the surface of the steel wire.

Figure 2:
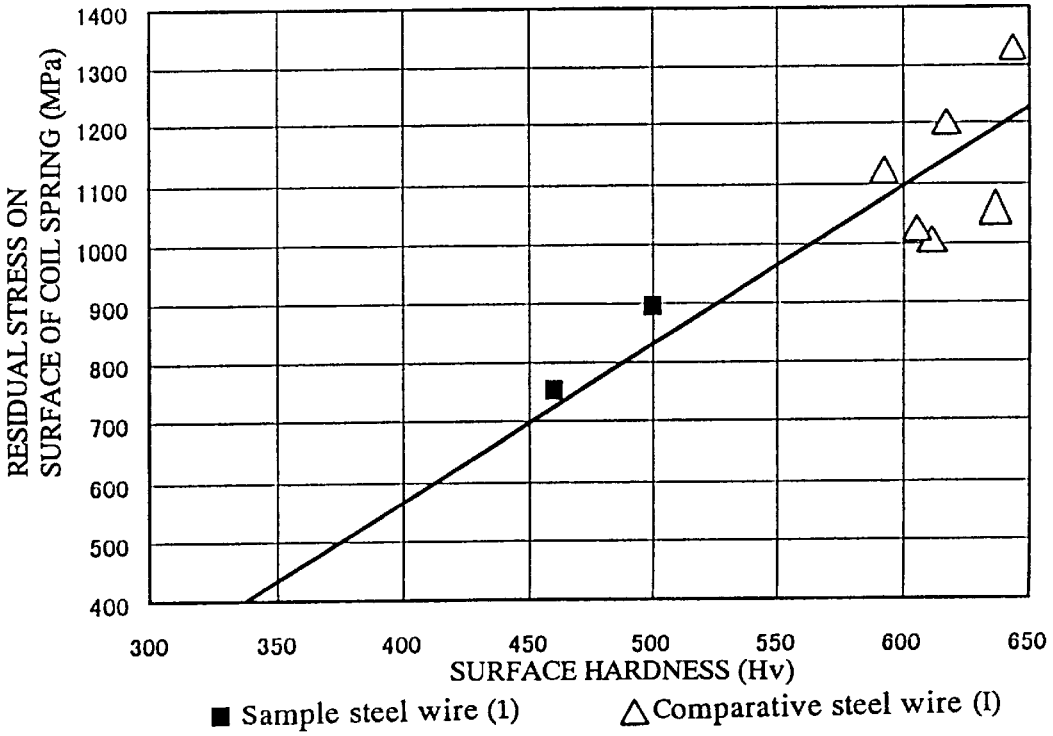
FIG. 2 is a graph showing residual stress on the surface of each the sample steel wire and comparative steel wires after the coiling process in relation to the surface hardness of each of the steel wires before the coiling process thereof.

In FIG. 2, there is shown residual stress (MPa) on the surface of the sample steel wire after the coiling process in relation to the surface hardness (Hv) of the sample steel wire before the coiling process. As shown in FIG. 2, it has been found that the residual stress on the surface of the sample steel wire after the coiling process tends to decrease in accordance with a decrease of the surface hardness. Since the surface hardness of the sample steel wire was decreased by decarburization, the residual stress on the surface of the sample steel wire after the coiling process was decreased.

Figure 3:
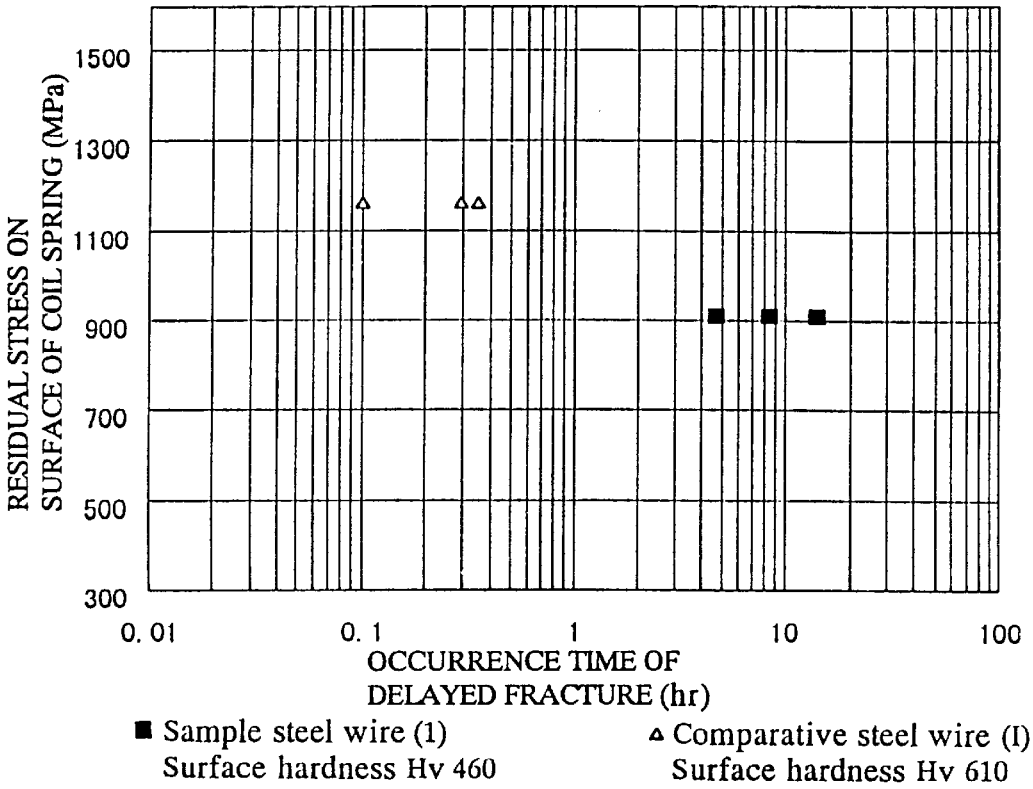
FIG. 3 is a graph showing residual stress on the surface of each of the sample steel wire and comparative steel wires after the coiling process in relation to an occurrence time of delayed fracture.

Illustrated in FIG. 3 is the residual stress (MPa) on the surface of the sample steel wire in relation to an occurrence time of delayed fracture in the case that the steel wire was clamped by stress of 98 MPa in solution of HCl of 1.896 in gravity. As shown in FIG. 3, it has been found that the residual stress on the surface of the sample steel wire of Hv 460 decreased less than that of the comparative steel wires (I) of Hv 610 after the coiling process. This implies that the occurrence of delayed fracture in the sample steel wire is remarkably delayed. Based on the result, it is assumed that if the residual stress on the surface of the steel wire after the coiling process is about 700 MPa. any delayed fracture does not occur even when 100 hours have passed.

Figure 4:
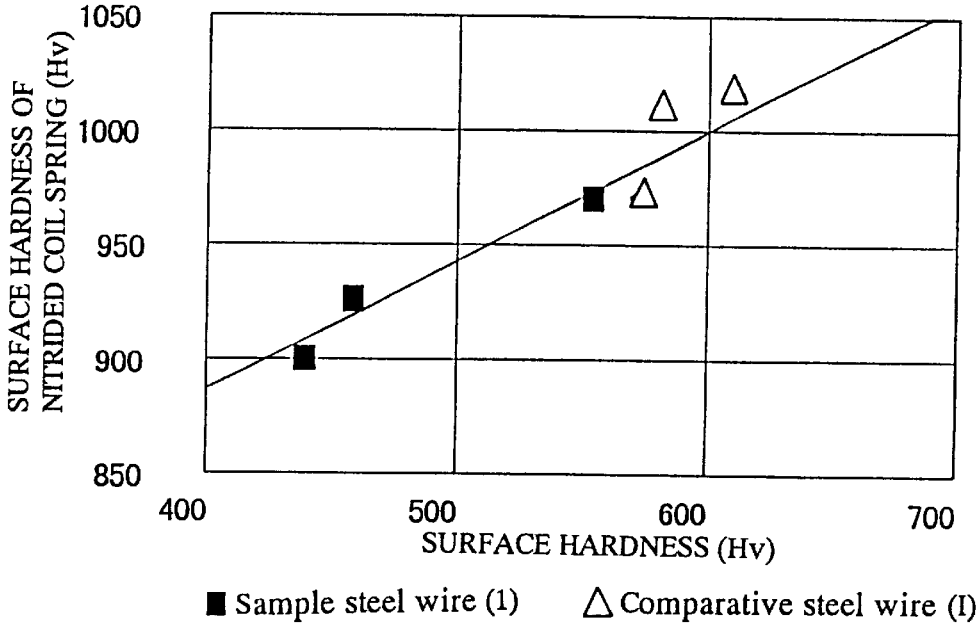
FIG. 4 is a graph showing the surface hardness of each of the sample steel wire and comparative steel wires after a nitriding process thereof in relation to the surface hardness of each of the same steel wires before the coiling process thereof.

In FIG. 4, there is shown the surface hardness of each of the sample and comparative steel wires nitrided at 500 ° C. in the atmosphere of ammonia gas for two hours in relation to the surface hardness of each of the oil-tempered steel wires. As shown in FIG. 4, it is has been found that the surface hardness of each of the nitrided steel wires tends to decrease in accordance with a decrease of the surface hardness of each of the steel wires for the following reason. As nitrogen as well as carbon is an element forming solid solution of the interstitial type, the surface hardness of the nitrided steel wire is determined by a sum of the amount of carbon contained in the surface of the steel wire and the amount of nitrogen invaded into the surface of the steel wire. It is, therefore, required to prolong the treatment time for nitriding of the steel wire in accordance with a decrease of the amount of carbon on the surface of the steel wire caused by decarburizing treatment.

As the durability of coil springs is determined by the surface strength of the steel wires, the nitriding treatment was carried out to increase the surface hardness of the coil spring more than Hv 900. In the case that the nitriding treatment is carried out at 500 ° C. to increase the surface hardness of the coil spring more than Hv 900 and finished within two hours to enhance productivity of the coil springs, it is required to retain the surface hardness of the steel wire more than Hv 420 prior to the nitriding treatment.

Figure 5A:
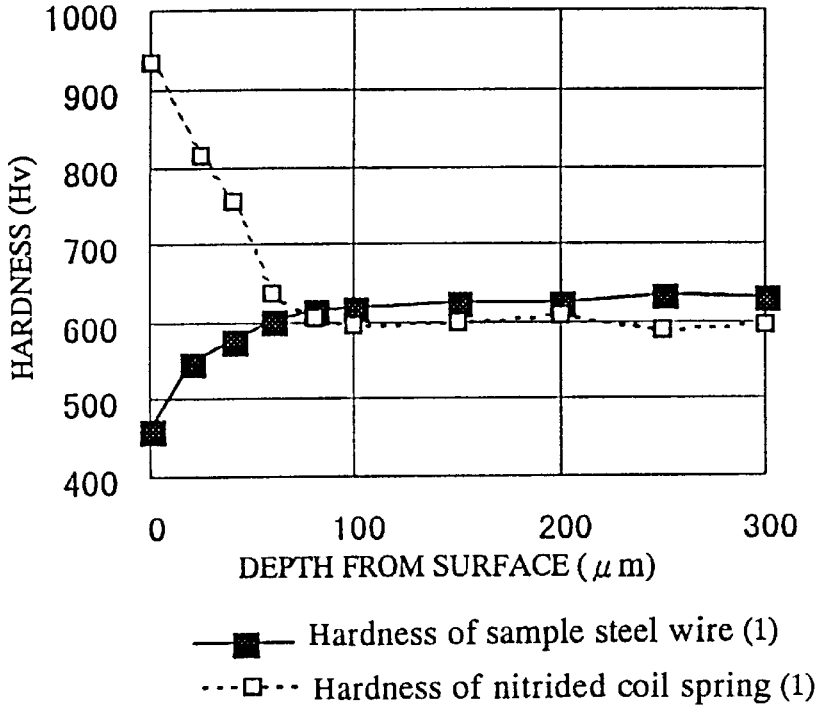
FIG. 5 (*a*) is a graph showing the hardness of the sample steel wire before the coiling process thereof and after the nitriding process thereof in relation to depth from the surface of the sample steel wire.
Figure 5B:
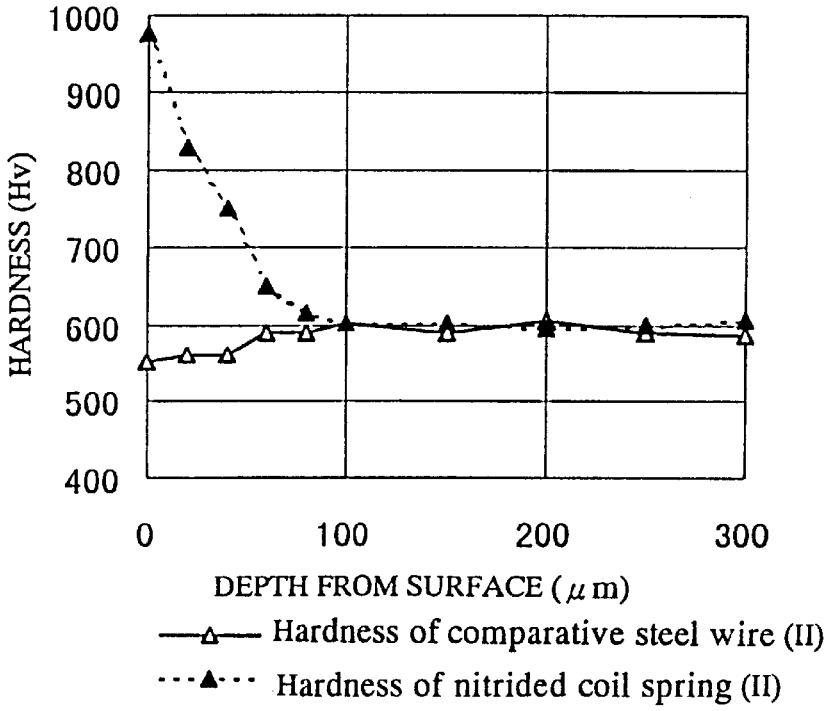

In FIGS. 5(A) and 5 (B), the hardness of each of the steel wires and the hardness (Hv) of each of the coil springs nitrided at 500 ° C. in the atmosphere of ammonia gas for two hours are shown in relation to depth from the surface or each of the coil spring. As shown in FIG. 5(A), the surface hardness of the coil spring made of the sample steel wire (1) is decreased by the decarburizing treatment less than the internal hardness of the coil spring in an extent of more than Hv 50. This implies that a decrease of residual stress after the coiling process is effective to restrain delayed fracture of the coil spring. In the case that the sample steel wire (1) of more than Hv 420 in surface hardness is used for making the coil spring, the surface hardness of the nitrided coil spring becomes more than Hv 900 sufficient for durability of the coil spring. For the reasons described above, it has been found that delayed fracture of the coil spring is effectively restrained when the surface hardness of the oil-tempered steel wire was determined in an extent between Hv 420 in a minimum value and hardness defined by subtraction of Hv 50 from the internal hardness of the coil springs in a maximum value. In the case that the maximum value of the surface hardness of the oil-tempered steel wire is adjusted in an extent of less than Hv 50, delayed fracture of the coil spring may not be restrained since the control of the surface hardness becomes difficult due to errors in carbon content during the decarburizing process for mass-production.

Figure 6:
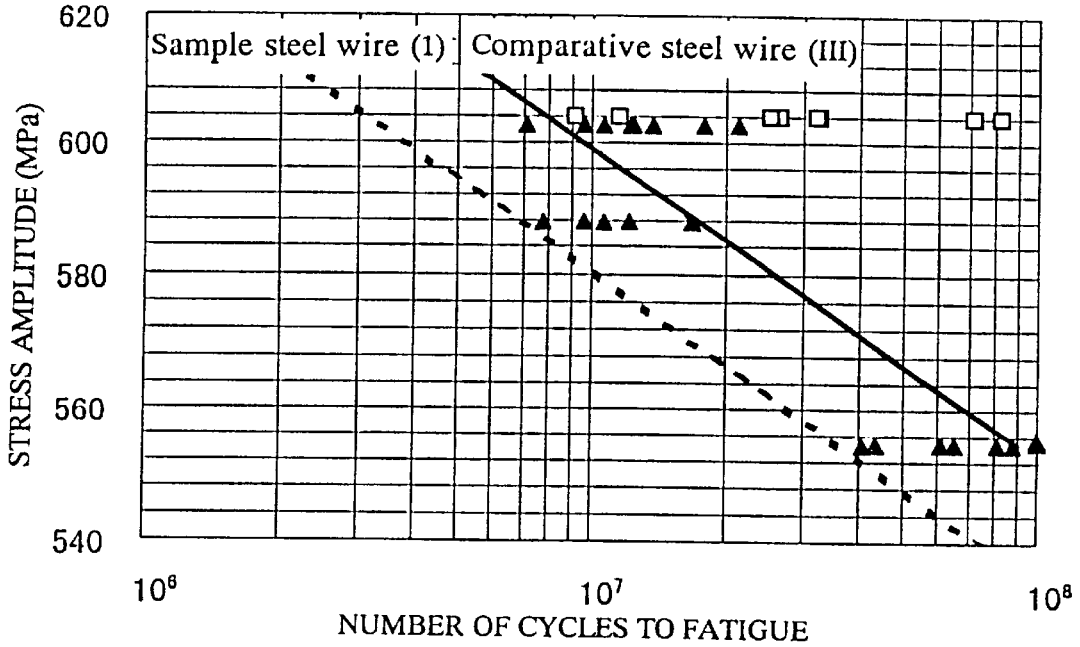
FIG. 6 is a graph showing test results of durability of the sample steel wires in comparison with the comparative steel wires.

In FIG. 6, there are shown fatigue test results of tile coil springs made of the sample steel wire (1) and comparative steel wires (I) to (III). From the test results, it has been found that the fatigue strength of the coil spring made of the sample steel wire (1) was increased by the nitriding treatment in a short period of time in spite of decarburizing treatment to the surface of the sample steel wire.

Although in the experiment described above, the present invention was adapted to an oil-tempered steel wire containing 0.45 to 0.8% C. 1.2 to 2.5% Si. 0.5 to 1.5% Mn and 0.5 to 2.0% Cr, by weight and at least one metallic element selected from the group of 0.1 to 0.7% Mo, 0.05 to 0.6% V, 0.2 to 2.0% Ni and 0.01 to 0.2% Nb, by weight and containing Fe and impurity elements as a remainder, the present invention can be effectively adapted to an oil-tempered steel wire of more than Hv 550 in internal hardness.

What is claimed is:

1. A coil spring made of an oil-tempered steel wire with internal hardness of more than Hv 550 in cross-section, the surface hardness of the oil-tempered steel wire being determined in an extent between Hv 420 in a minimum value and hardness defined by subtraction of Hv 50 from the internal hardness in a maximum value.

2. A coil spring as claimed in claim 1, wherein the surface of the oil-tempered steel wire is decarburized during heating prior to a quenching process thereof to determine the surface hardness of the oil-tempered steel wire in the extent between Hv 420 in a minimum value and harness defined by subtraction of Hv 50 from the internal hardness in a maximum value.

3. A coil spring as claimed in claim 1, wherein the oil-tempered steel wire contains 0.45 to 0.8% C. 1.2 to 2.5 % Si, 0.5 to 1.5% Mn and 0.5 to 2.0% Cr, by weight and at least one metallic element selected from the group consisting of 0.1 to 0.7% Mo, 0.05 to 0.6% V, 0.2 to 2.0% Ni and 0.01 to 0.2% Nb, by weight and contains Fe and impurity elements as a remainder.

4. A manufacturing method of a coil spring made of an oil-tempered steel wire with internal hardness of more than Hv 550 in cross-section, comprising the steps of:

decarburizing the surface of the oil-tempered steel wire during heating prior to a quenching process thereof to determine the surface hardness of the oil-tempered steel wire in an extent between Hv 420 in a minimum value and hardness defined by subtraction of Hv 50 from the internal hardness in a maximum value; and coiling the oil-tempered steel wire for making a coil spring.

5. A manufacturing method of a coil spring as claimed in claim 4, further comprising the steps of:

applying nitriding treatment to the coil spring; and applying shot peening treatment to the nitrided coil spring.

* * * * *